US008244161B2

(12) United States Patent
Izumi et al.

(10) Patent No.: US 8,244,161 B2
(45) Date of Patent: Aug. 14, 2012

(54) DEVELOPING APPARATUS

(75) Inventors: Takao Izumi, Yokohama (JP); Hiroshi Murata, Yokohama (JP); Takashi Hatakeyama, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 470 days.

(21) Appl. No.: 12/550,619

(22) Filed: Aug. 31, 2009

(65) Prior Publication Data

US 2010/0054818 A1 Mar. 4, 2010

Related U.S. Application Data

(60) Provisional application No. 61/093,575, filed on Sep. 2, 2008.

(51) Int. Cl.
*G03G 15/08* (2006.01)

(52) U.S. Cl. ..... 399/257; 399/27; 399/29; 399/254; 399/262

(58) Field of Classification Search ..... 399/27, 399/29, 252, 254, 257, 262, 264; 430/30
See application file for complete search history.

(56) References Cited

U.S. PATENT DOCUMENTS

| | | | | | |
|---|---|---|---|---|---|
| 4,614,165 | A * | 9/1986 | Folkins et al. | ..... | 399/257 |
| 4,629,309 | A * | 12/1986 | Tsukano et al. | ..... | 399/257 |
| 5,235,391 | A * | 8/1993 | Aimoto | ..... | 399/29 |
| 5,250,749 | A * | 10/1993 | Aimoto | ..... | 399/257 |
| 5,592,270 | A * | 1/1997 | Takai et al. | ..... | 399/260 |
| 6,125,243 | A * | 9/2000 | Shoji et al. | ..... | 399/29 |
| 7,376,374 | B2 * | 5/2008 | Adachi | ..... | 399/254 |
| 2008/0199223 | A1 * | 8/2008 | Tateyama et al. | ..... | 399/254 |

FOREIGN PATENT DOCUMENTS

JP 09-185177 7/1997

* cited by examiner

*Primary Examiner* — Sandra Brase
(74) *Attorney, Agent, or Firm* — Turocy & Watson, LLP

(57) ABSTRACT

A developing apparatus includes a tank configured to contain a developing agent including a toner and a carrier, the tank having a discharge port configured to discharge the developing agent overflowing from the tank, a supplier configured to develop a latent image by using the toner contained in the tank, a replenisher configured to contain the developing agent and to replenish the developing agent into the tank, and a controller configured to estimate an amount of the developing agent in the tank in according with the amount of the supplied developing agent and the amount of the replenished developing agent and to execute a forced discharge for forcibly discharging the developing agent contained in the tank from the discharge port based on the estimated amount of developing agent.

20 Claims, 10 Drawing Sheets

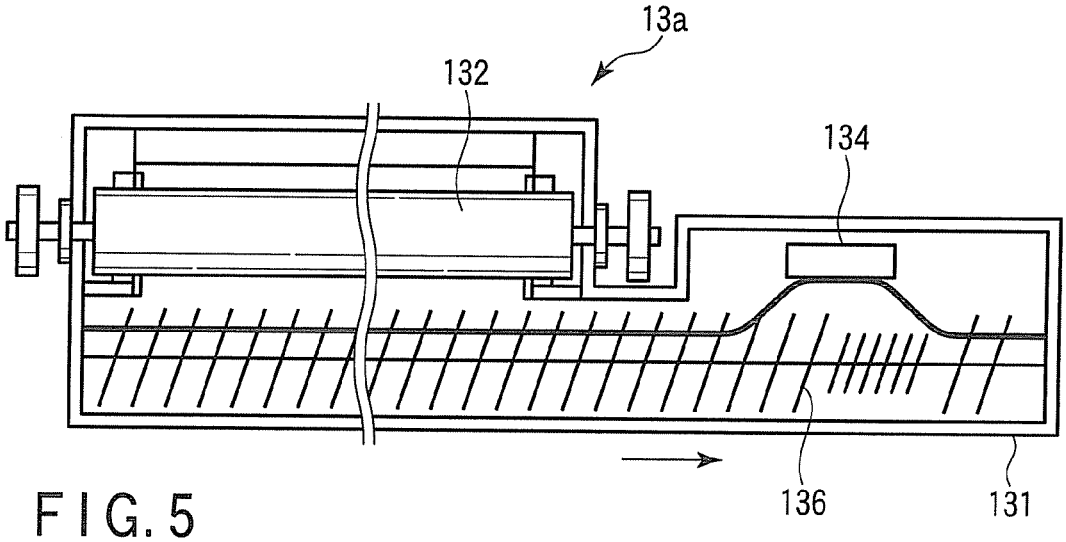
FIG. 5
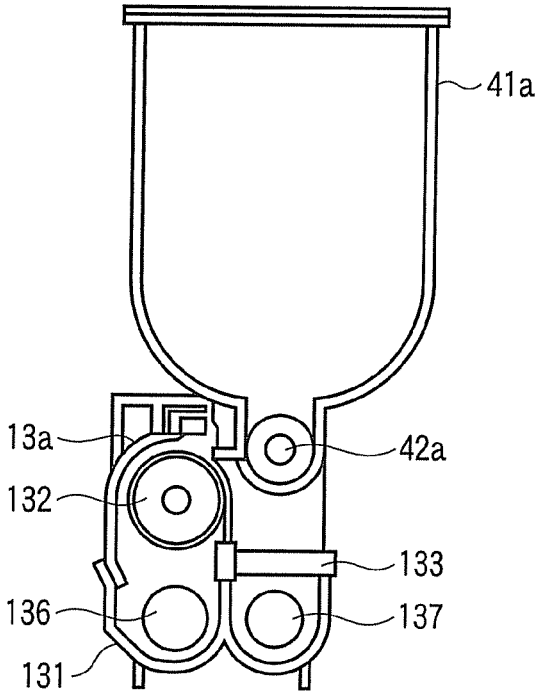
FIG. 6
| Printing ratio | 60% | 65% | 75% | 85% |
|---|---|---|---|---|
| Developer amount | 480g | 500g | 520g | 540g |
| Density unevenness level | 2 | 2 | 3 | 4 |
FIG. 7

| Value of supply ratio 1 | 65~69 | 70~74 | 75~79 | 80~84 | 85~89 | 90 or more |
|---|---|---|---|---|---|---|
| Forced discharge time | 100sec | 120sec | 140sec | 160sec | 180sec | 200sec |

DEVELOPING APPARATUS

CROSS-REFERENCE TO RELATED APPLICATION

This application claims the benefit of U.S. Provisional Application No. 61/093,575, filed Sep. 2, 2008.

TECHNICAL FIELD

The present invention relates to a technique for keeping constant a developer amount in a developing apparatus in an image forming apparatus.

BACKGROUND

In apparatuses employing an electrophotographic technique such as a copying machine, a printer, and a facsimile, a two-component developer including a toner and a carrier for developing an electrostatic latent image on the surface of a photoconductive member is contained in a developing device. The developing device supplies the toner to the surface of the photoconductive member.

In a dry two-component developer, a toner is consumed by development of a latent image but a carrier remains in the developing device. A resin coat material on the surface of the carrier peels or a toner component adheres to the surface. Such a carrier lowers charging performance of the developer and causes deterioration in an image characteristic.

JP-A-9-185177 discloses a developing method for storing a developer as a mixture of a toner and a small amount of carrier in a toner cartridge and supplying the carrier to a developing device together with the toner in order to gradually replace the carrier.

However, in the developing method disclosed in JP-A-9-185177, the carrier is supplied to the developing device simultaneously with the supply of the toner. Therefore, when an image with a high printing ratio is continuously printed on a large number of sheets, the developer in the developing device increases. In particular, when a developer surface position under a developing roller rises, the developer once used for development is directly served for development again. Originally, the developer once used for development is peeled off onto a carrying mixer and agitated and carried. However, when the developer surface position under the developing roller rises, the developer used for development is dragged by the rotation of the developing roller. The rise in the developer surface position under the developing roller causes image deterioration such as density unevenness of a solid image.

Therefore, the present invention provides a developing apparatus that efficiently discharges a developer contained in a tank and suppresses an increase in a developer amount.

SUMMARY

According to one aspect of the present invention, there is provided a developing apparatus including: a tank configured to contain a developing agent including a toner and a carrier, the tank having a discharge port configured to discharge the developing agent overflowing from the tank, a supplier configured to develop a latent image by using the toner contained in the tank, a replenisher configured to contain the developing agent and to replenish the developing agent into the tank; and a controller configured to estimate an amount of the developing agent in the tank in according with the amount of the supplied developing agent and the amount of the replenished developing agent and to execute a forced discharge for forcibly discharging the developing agent contained in the tank from the discharge port based on the estimated amount of developing agent.

DESCRIPTION OF THE DRAWINGS

FIG. 5 is a side sectional view taken in the longitudinal direction of the developing device;

FIG. 6 is a plan view of the developing device;

FIG. 7 is a table representing a developer amount and an evaluation value of a density unevenness level after continuous printing at each printing ratio;

DETAILED DESCRIPTION

An embodiment of the present invention is explained below with reference to the accompanying drawings. A developing system according to this embodiment includes an image forming apparatus 101 shown in FIG. 1 and a control system therefor shown in FIG. 15.

Figure 1:
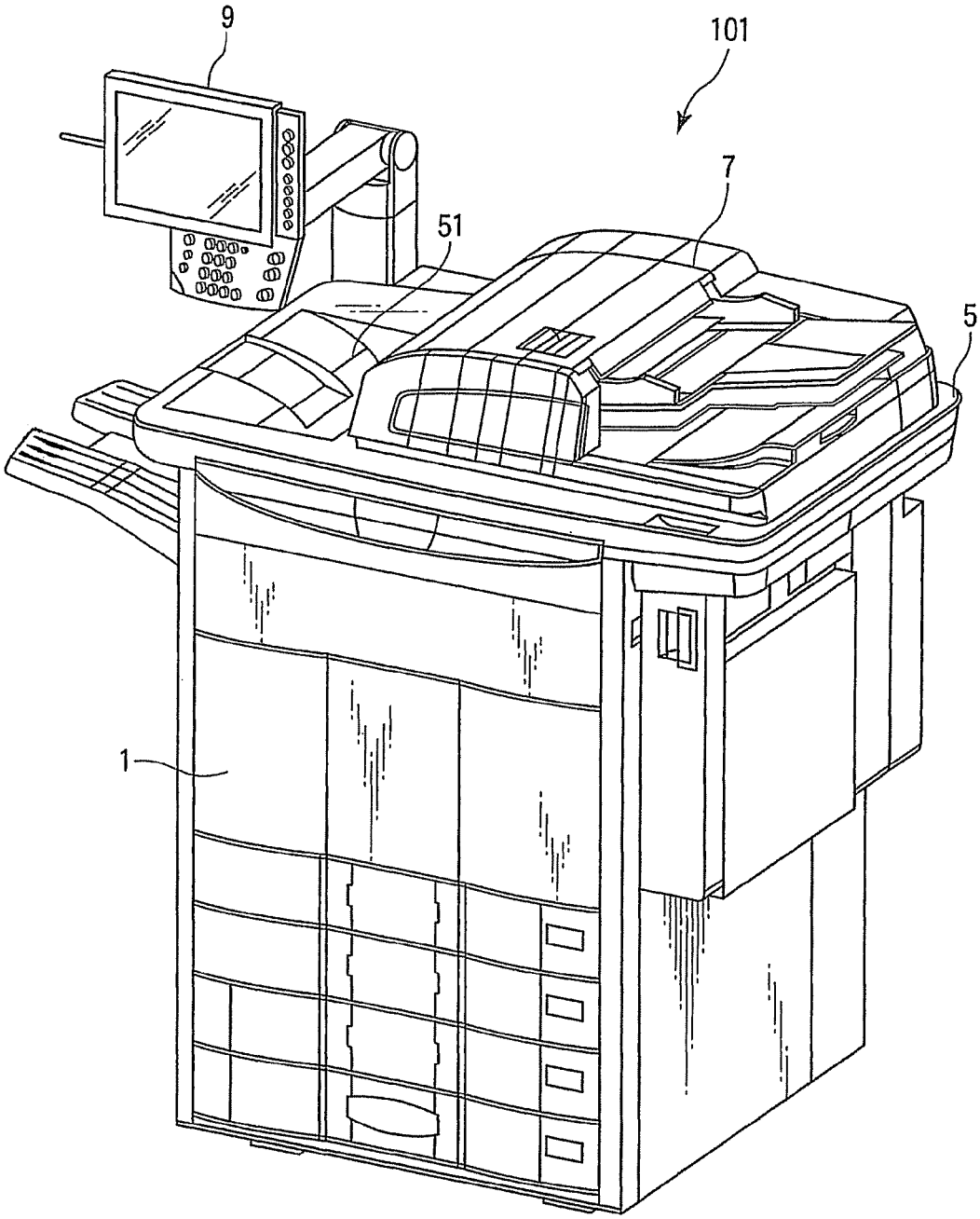
FIG. 1 is a perspective view of an external appearance of an image forming apparatus.

FIG. 1 is a perspective view of an external appearance of the image forming apparatus 101 according to this embodiment. The Image forming apparatus 101 is, for example, a color copying machine of a quadruple tandem system. The image forming apparatus 101 includes an image forming unit 1, a sheet feeding unit 3, and a scanner (an image reading unit) 5. The image forming unit 1 outputs image information as an output image called, for example, hardcopy or printout. The sheet feeding unit 3 feeds a sheet of an arbitrary size used for image output to the image forming unit 1. The image reading unit 5 captures image information, which is subjected to image formation in the image forming unit 1, from an original document that keeps the image information.

An auto document feeder 7 is provided above the image forming unit 1. The auto document feeder 7 discharges, when an original document is a sheet-like document, the document from a reading position to a discharge position after image information is read from the document in the image reading unit 5 and guides the next document to the reading position. An instruction input unit for instructing the start of image formation in the image forming unit 1 and the start of reading of image information of an original document by the image reading unit 5, i.e., a display unit 9 as a control panel is provided in the image forming apparatus 101.

Figure 2:
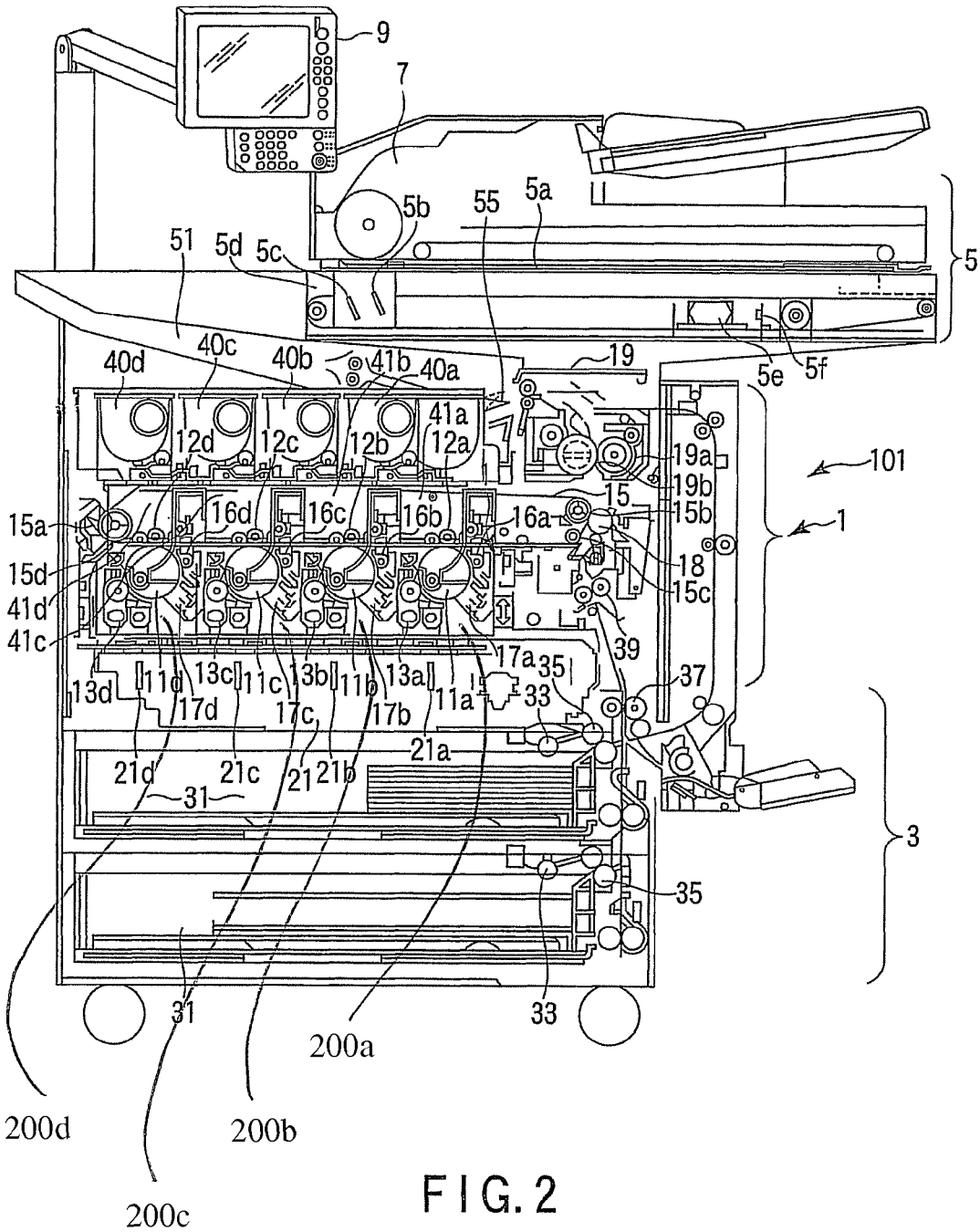
FIG. 2 is a schematic diagram of the internal structure of the image forming apparatus viewed from the front side.

FIG. 2 is a schematic diagram of the internal structure of the image forming apparatus 101 viewed from the front side. First, the structure of the image reading unit 5 is explained. The image reading unit 5 includes a transparent platen glass 5*a* on which an original document is placed, a light source 5*b* that irradiates the original document, and a reflection mirror 5*c* that reflects light reflected from the original document. The light source 5*b* and the reflection mirror 5*c* are provided integrally with a document lighting unit 5*d* that freely moves in the horizontal direction. Light reflected by the original lighting unit 5*d* is received by a CCD 5*f* via a focusing lens 5*e* arranged on an optical path.

A configuration of the image forming unit 1 is explained. Toner cartridges 40*a* to 40*d* are provided in parallel on an upper side of the image forming unit 1. The toner cartridge 40*a* contains a developer including a yellow toner. The toner cartridge 40*b* contains a developer including a magenta toner. The toner cartridge 40*c* contains a developer including a cyan toner. The toner cartridge 40*d* contains a developer including a black toner. The developer refers to a two-component developer as a mixture of the toner of each of the colors, for example, the yellow toner, and a ferrite carrier. Toner hoppers 41*a* to 41*d* are provided in parallel below the toner cartridges 40*a* to 40*d*. The toner cartridge 40*a* supplies the developer to the toner hopper 41*a*. The toner hopper 41*a* replenishes the developer to a developing device 13*a* explained later. The hoppers 41*b* to 41*d* replenish the developers in the same manner.

The image forming unit 1 includes photoconductive drums 11*a* to 11*d*, developing devices 13*a* to 13*d*, an intermediate transfer belt 15, cleaners 16*a* to 16*d*, electrifying chargers 17*a* to 17*d*, and an exposing device 21. The photoconductive drums 11*a* to 11*d* are image bearing members that hold electrostatic latent images. The developing devices 13*a* to 13*d* reversely develop the electrostatic latent images formed on the photoconductive drums 11*a* to 11*d*. The developing device 13*a* contains the developer including the yellow toner. The developing device 13*b* contains the developer including the magenta toner. The developing device 13*c* contains the developer including the cyan toner. The developing device 13*d* contains the developer including the black toner. The intermediate transfer belt 15 is a transfer member that sequentially holds, in a stacked state, toner images developed on the photoconductive drums 11*a* to 11*d*. The cleaners 16*a* to 16*d* remove surface charges of the photoconductive drums 11*a* to 11*d* with uniform light irradiation and remove toners remaining on the photoconductive drums 11*a* to 11*d* from the respective photoconductive drums 11*a* to 11*d* and contain the toners. The electrifying chargers 17*a* to 17*d* negatively charge the photoconductive drums 11*a* to 11*d* uniformly. The exposing device 21 includes laser diodes (LDs) 21*a* to 21*d* that irradiate laser beams, which are modulated according to image data for writing, on the photoconductive drums 11*a* to 11*d* and form electrostatic latent images thereon. The exposing device 21 may include an LED or the like.

The photoconductive drum 11*a*, the developing device 13*a*, the cleaner 16*a*, the electrifying charger 17*a*, and the LD 21*a* form a process unit 200*a*. The process unit 200*a* is arranged around the photoconductive drum 11*a*. Around the photoconductive drum 11*a*, the LD 21*a* is provided downstream of the electrifying charger 17*a* and the developing device 13*a* is provided downstream of the LD 21*a* in a rotating direction of the photoconductive drum 11*a*. The photoconductive drum 11*a* is provided in contact with the intermediate transfer belt 15. The cleaner 16*a* is provided further downstream than a section where the intermediate transfer belt 15 is in contact with the photoconductive drums 11*a* to 11*d* (a primary transfer section).

The process unit 200*a* starts one cycle of transfer to the intermediate transfer belt 15 when the electrifying charger 17*a* charges the photoconductive drum 11*a*. The process unit 200*a* completes the one cycle of transfer to the intermediate transfer belt 15 when the cleaner 16*a* removes the toner according to the rotation of the photoconductive drum 11*a*. The process unit 200*a* starts the next one cycle of transfer to the intermediate transfer belt 15 when the electrifying charger 17*a* uniformly charges the uncharged photoconductive drum 11*a*.

Like the process unit 200*a*, process units 200*b*, 200*c*, and 200*d* including the photoconductive drums 11*b*, 11*c*, and 11*d*, respectively, are provided in the image forming unit 1. Therefore, the four process units are provided in the image forming unit 1.

The image forming unit 1 further includes a transfer device 18 and a fixing device 19. The transfer device 18 is a secondary transfer section that transfers toner images stacked on the intermediate transfer belt 15 onto a sheet. The fixing device 19 fixes the toner images, which are transferred on the sheet, on the sheet.

The intermediate transfer belt 15 is stretched and suspended by a driving roll 15*a*, a backup roll 15*b*, and a tension roll 15*c*. The driving roll 15*a* rotationally moves the intermediate transfer belt 15. The backup roll 15*b* is a roller for secondary transfer. The tension roll 15*c* fixes tension applied to the intermediate transfer belt 15. In a section where the driving roll 15*a* is provided in the intermediate transfer belt 15, a belt cleaner 15*d* is disposed in contact with the intermediate transfer belt 15 in a position opposed to the driving roll 15*a* across the intermediate transfer belt 15. The intermediate transfer belt 15 has width substantially equal to the dimension of the photoconductive drums 11*a* to 11*d* in a direction orthogonal to a conveying direction of a sheet. The intermediate transfer belt 15 has a seamless belt shape.

The intermediate transfer belt 15 is formed of polyimide resin having thickness of 100 μm in which carbon is uniformly dispersed. The intermediate transfer belt 15 has electric resistance of $10^9$ Ωcm. The intermediate transfer belt 15 is semiconductive. The intermediate transfer belt 15 only has to be a semiconductive material having volume resistivity of $10^8$ to $10^{11}$ Ωcm. For example, the intermediate transfer belt 15 may be formed of a material obtained by dispersing conductive particles of carbon or the like in polyethylene terephthalate, polycarbonate, polytetrafluoroethylene, polyvinylidene fluoride, or the like. A polymer film with electric resistance adjusted by composition adjustment may be used for the intermediate transfer belt 15. The intermediate transfer belt 15 may be formed of a material obtained by mixing an ion conductive substance in the polymer film or a rubber material of silicon rubber, urethane rubber, or the like having relatively low electric resistance.

In the primary transfer section, primary transfer rolls 12*a* to 12*d* as transfer devices are respectively disposed in press contact with the photoconductive drums 11*a* to 11*d* via the intermediate transfer belt 15 on the rear surface side of the intermediate transfer belt 15. In other words, the primary transfer rolls 12*a* to 12*d* are provided to be opposed to and in contact with the process units 200*a* to 200*d* via the intermediate transfer belt 15. The primary transfer roll 12*a* is connected to a not-shown positive DC power supply. The primary transfer rolls 12*b* to 12*d* are connected in the same manner as the primary transfer roll 12*a*.

The transfer device 18 is disposed in contact with a toner carrying surface side of the intermediate transfer belt 15. The transfer device 18 is disposed on the rear surface side of the intermediate transfer belt 15 and opposed to the backup roll 15*b*. The backup roll 15*b* has a counter electrode opposed to the transfer device 18.

Color image forming operation in the image forming apparatus 101 is explained. When an instruction for starting image formation is input to the image forming apparatus 101, the photoconductive drum 11*a* receives driving force from a not-shown driving mechanism and starts rotation. The photoconductive drum 11*a* has a cylindrical shape with a diameter of 30 mm. The electrifying charger 17*a* uniformly charges the photoconductive drum 11*a* to about −600 V. The LD 21*a* irradiates light corresponding to an image, which should be recorded, on the photoconductive drum 11*a*, and forms an electrostatic latent image thereon.

The developing device 13*a* gives a bias value −380 V to a not-shown developing sleeve with a not-shown developing bias power supply and forms a developing field between the developing sleeve and the photoconductive drum 11*a*. The developing field is formed in a direction from the front surface of the photoconductive drum 11*a* to the developing sleeve of the developing device 13*a*. The yellow toner contained in the developing device 13*a* and negatively charged adheres to an area of image section potential (a high potential section) of the electrostatic latent image on the photoconductive drum 11*a*. The structure of the developing device 13*a* is explained in detail later.

The developing device 13*b* develops the electrostatic latent image and forms a magenta toner image on the photoconductive drum 11*b* with a method different from the formation of a yellow toner image on the photoconductive drum 11*a* by the developing device 13*a*. The magenta toner has a volume average particle diameter of 7 μm, which is the same as that of the yellow toner. The magenta toner is negatively charged by triboelectric charging with ferrite magnetic carrier particles having a volume average particle diameter of about 50 μm. An average charging amount of the magenta toner is about −30 μC/g. The developing device 13*b* gives a bias value of −380 V to a not-shown developing sleeve with a not-shown developing bias power supply and forms a developing field between the developing sleeve and the photoconductive drum 11*b*. The negatively-charged magenta toner adheres to an area of a high potential section of the electrostatic latent image of the photoconductive drum 11*b*.

In a transfer area Ta formed by the photoconductive drum 11*a*, the intermediate transfer belt 15, and the primary transfer roll 12*a* in the process unit 200*a*, bias voltage of about +1000 V is applied to the primary transfer roll 12*a* from a DC power supply. A transfer field is formed between the primary transfer roll 12*a* and the photoconductive drum 11*a*. The yellow toner image on the photoconductive drum 11*a* is transferred onto the intermediate transfer belt 15 according to the transfer field.

The primary transfer roll 12*a* is explained in detail. The primary transfer roll 12*a* is a conductive foamed urethane roller that is made conductive by dispersing carbon therein. The primary transfer roll 12*a* is formed by providing a roller having an outer diameter of ϕ18 mm around a core bar of ϕ10 mm. Electric resistance between the core bar and the roller surface is about $10^6$ Ω. A not-shown constant voltage DC power supply is connected to the core bar. A power feeding device in the primary transfer roll 12*a* is not limited to the roller and may be a conductive brush, a conductive rubber blade, a conductive sheet, or the like. The conductive sheet is a rubber material or a resin film in which carbon is dispersed. The conductive sheet may be a rubber material such as silicon rubber, urethane rubber, or EPDM or a resin material such as polycarbonate. The conductive sheet desirably has volume resistivity of $10^5$ to $10^7$ Ωcm.

A pair of springs are provided at both the ends of the primary transfer roll 12*a*. The primary transfer roll 12*a* is urged in the vertical direction to elastically come into contact with the intermediate transfer belt 15 by the pair of springs. The magnitude of urging force by the pair of springs provided in the primary transfer roll 12*a* is 600 gft. Urging force of one spring of the pair of springs is 300 gft. The primary transfer rolls 12*b* to 12*d* are formed in the same manner as the primary transfer roll 12*a* and elastically come into contact with the intermediate transfer belt 15 in the same manner as the primary transfer roll 12*a*. Therefore, explanation of the primary transfer rolls 12*b* to 12*d* is omitted.

The intermediate transfer belt 15 on which the yellow toner image is transferred in the transfer area Ta is rotated to a transfer area Tb. In the transfer area Tb in the process unit 200*b*, bias voltage of about +1200 V is applied to the primary transfer roll 12*b* from the DC power supply. A magenta toner image on the photoconductive drum 11*b* is transferred onto the intermediate transfer belt 15 to be superimposed on the yellow toner image according to the transfer field. In a transfer area Tc in the process unit 200*c*, bias voltage of about +1400 V is applied to the primary transfer roll 12*c* from the DC power supply. A cyan toner image on the photoconductive drum 11*c* is transferred onto the intermediate transfer belt 15 to be superimposed on the yellow toner image and the magenta toner image according to the transfer field. In a transfer area Td in the process unit 200*d*, bias voltage of about +1600 V is applied to the primary transfer roll 12*d* from the DC power supply. A black toner image on the photoconductive drum 11*d* is transferred onto the intermediate transfer belt 15 to be superimposed on the yellow toner image, the magenta toner image, and the cyan toner image according to the transfer field. As explained above, the toner images are multiply transferred onto the intermediate transfer belt 15.

The sheet feeding unit 3 feeds a sheet to the transfer device 18 at predetermined timing when the transfer device 18 transfers the toner images onto the sheet. A cassette set in a cassettes slot 31 contains sheets of an arbitrary size. A pickup roller 33 extracts a sheet according to image forming operation. A size of the sheet corresponds to the size of toner images formed by the image forming unit main body 1. A separating mechanism 35 prevents two or more sheets from being extracted by the cassette by the pickup roller 33. Plural conveying rollers 37 convey the one sheet limited by the separating mechanism 35 to a registration roller pair 39. The registration roller pair 39 sends the sheet to a transfer position where the transfer device 18 and the intermediate transfer belt 15 are in contact with each other according to timing when the transfer device 18 transfers the toner images from the intermediate transfer belt 15. Plural cassette slots 31, plural pickup rollers 33, and plural separating mechanisms 35 are prepared according to necessity. Cassettes can be arbitrarily inserted in different slots.

The backup roll 15*b* and the transfer device 18 transfer the toner images of the plural colors, which are transferred on the intermediate transfer belt 15, onto a sheet such as paper in the secondary transfer section. Predetermined bias is applied to the transfer device 18. The transfer device 18 forms a transfer field between the transfer device 18 and the backup roll 15*b* across the intermediate transfer belt 15. The transfer device 18 and the backup roll 15*b* collectively transfer the multiple color toner images on the intermediate transfer belt 15 onto the sheet.

The sheet on which image information is fixed via the fixing device 19 is discharged to a paper discharge tray 51 on a side of the image reading unit 5 and above the image forming unit main body 1. The fixing device 19 includes a fixing roller 19*a* and a pressing roller 19*d* on a downstream side in a paper discharging direction. On the sheet having the toner images transferred thereon, the toner images are melted and the image information is fixed by the heated fixing roller 19*a* and the pressing roller 19*d*.

Figure 3:
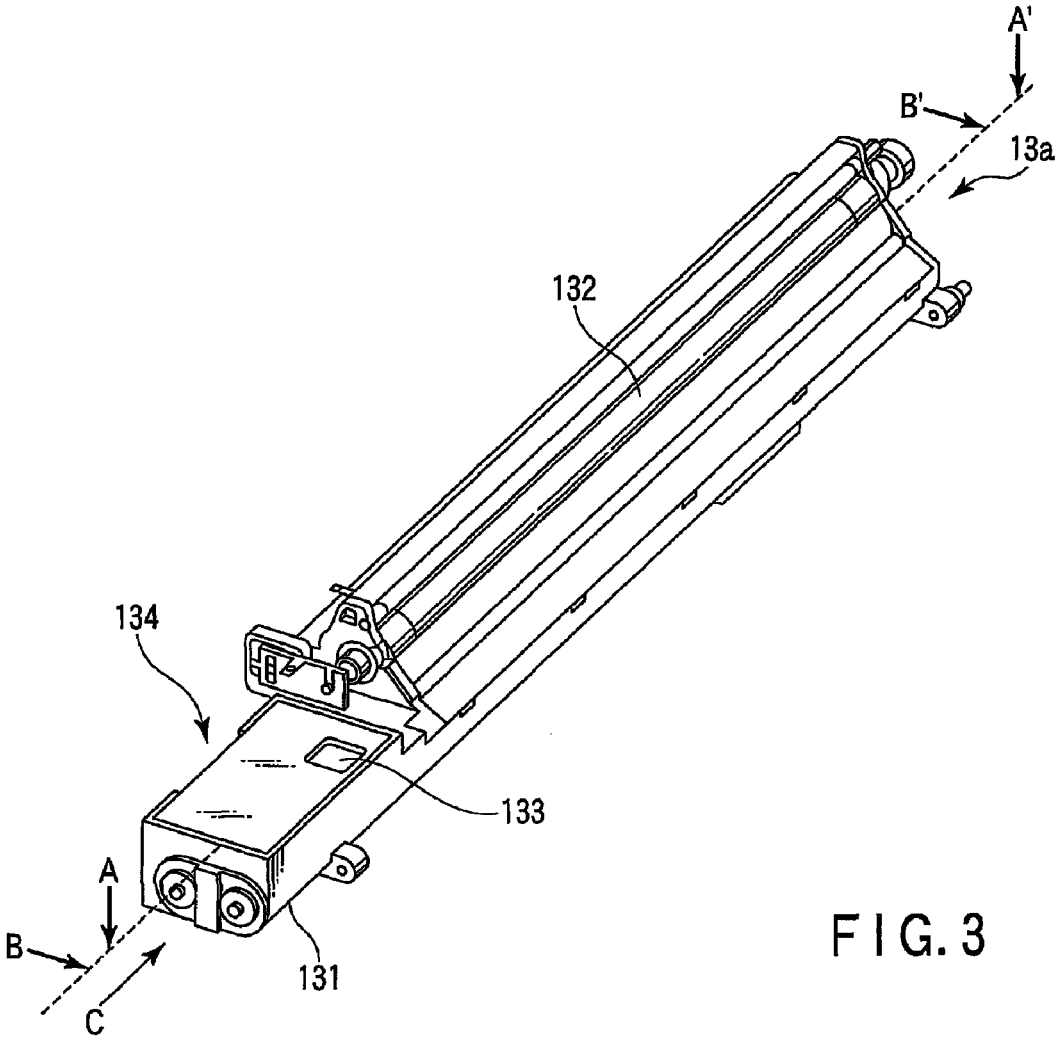
FIG. 3 is a perspective view of a developing device.
Figure 4:
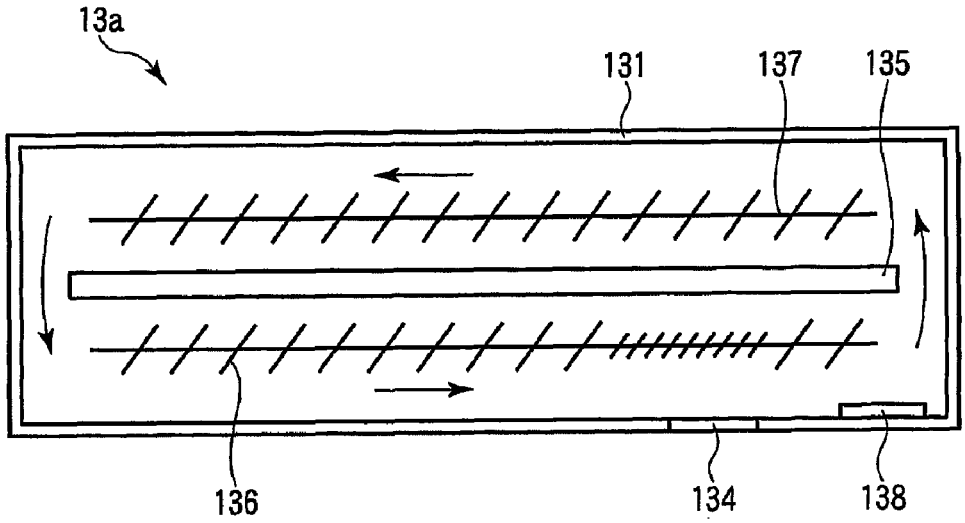
FIG. 4 is a top sectional view taken in a longitudinal direction of the developing device.

The structure of the developing device 13*a* according to this embodiment is explained. FIG. 3 is a perspective view of the developing device 13*a*. FIG. 4 is a top sectional view taken along A-A' in a longitudinal direction of the developing device 13*a* shown in FIG. 3. FIG. 5 is a side sectional view taken along B-B' in the longitudinal direction of the developing device 13*a* shown in FIG. 3. FIG. 6 is a diagram of the developing device 13*a* viewed from an arrow C direction in FIG. 3. The developing device 13*a* is explained below. However, the developing devices 13*b* to 13*d* are the same as the developing device 13*a*.

As shown in FIG. 3, the developing device 13*a* includes a developer tank 131, a developing roller 132, a replenishment port 133, and a discharge port 134. The developer tank 131 contains a developer. The developing roller 132 as a developing agent supplier is provided to freely rotate. The developing roller 132 is arranged to be opposed to the photoconductive drum 11*a*. The developing roller 132 rotates to thereby supply a toner and a carrier contained in the developer tank 131 to the developing roller 132 itself.

The replenishment port 133 is provided in an upper surface of the developer tank 131. The replenishment port 133 supplies the yellow toner from the toner cartridge 40*a* to the developer tank 131 via the toner hopper 41*a*. The discharge port 134 is provided on a side of the developer tank 131. The discharge port 134 discharges the developer contained in the developer tank 131 when the developer overflows. The discharge port 134 is formed in a rectangular shape and has long sides in a direction parallel to the longitudinal direction of the developer tank 131 and has short sides in a height direction orthogonal to the longitudinal direction of the developer tank 131.

As shown in FIG. 4, the developer tank 131 includes a partition plate 135, a first mixer 136, a second mixer 137, and a toner density detecting device 138. The developer tank 131 is divided into two spaces in the longitudinal direction by the partition plate 135. The two spaces communicate with each other at the both ends in the longitudinal direction of the developer tank 131.

The first mixer 136 and the second mixer 137 are provided in the longitudinal direction of the developer tank 131. The first mixer 136 and the second mixer 137 rotate to agitate and carry the developer in the developer tank 131. The first mixer 136 carries the developer in a direction opposite to a carrying direction of the developer by the second mixer 137 in the longitudinal direction of the developer tank 131. Therefore, the developer circulates in arrow directions in the two spaces in the developer tank 131. During printing by the image forming apparatus 101, the developing roller 132, the first mixer 136, and the second mixer 137 rotate at the number of revolutions during normal printing set in advance.

The replenishment port 133 shown in FIG. 3 is provided in a position opposed to the second mixer 137 in the developer tank 131. The developer is supplied to the space of the developer tank 131 in which the second mixer 137 is provided. The developing roller 132 shown in FIG. 3 is provided in a position opposed to the first mixer 136 in the developer tank 131. The space of the developer tank 131 in which the first mixer 136 is provided is a developer carrying path on the developing roller 132 side. The toner density detecting device 138 is provided in the space of the developer tank 131 in which the first mixer 136 is provided. The toner density detecting device 138 detects toner density of the developer carried by the first mixer 136.

As shown in FIG. 5, the developing roller 132 is provided from the one end side to near the center in the longitudinal direction of the developer tank 131. The discharge port 134 is provided on the other end side of the developer tank 131 on which the developing roller 132 is not provided. In a direction in which the developer flows, the developing roller 132 is on an upstream side and the discharge port 134 is on a downstream side. In the developer tank 131, the height in the height direction between the developing roller 132 and the discharge port 134 is set smaller than the height of other positions. In the first mixer 136, a diameter of a screw in a position near the discharge port 134 is set small and a pitch of the screw is set narrow.

A flow rate of the developer in the developer tank 131 falls around the discharge port 134 because of shapes of the developer tank 131 and the first mixer 136. A flow rate of the developer on the side on which the discharge port 134 is provided is lower than a flow rate of the developer on the side on which the developing roller 132 is provided. Therefore, the surface (a bold solid line in FIG. 5) of the developer flowing in the developer tank 131 swells in an arc shape on the side on which the discharge port 134 is provided in the developer tank 131 when the developer flows toward the arrow direction shown in FIG. 5.

The discharge port 134 is provided, on the basis of shapes of the developer tank 131 and the first mixer 136 and rotating speed of the developing roller 132, the first mixer 136, and the second mixer 137, such that a top portion of the arc of the developer surface coincides with a lower end in the center of the discharge port 134 in a state in which a reference amount of the developer is contained in the developer tank 131. Therefore, the developer surface does not fluctuate at the lower end in the center of the discharge port 134. When the developer is supplied from the toner cartridge 40*a* to the developing device 13*a* anew, the developer in the developer tank 131 overflows from the discharge port 134 by an amount of the supplied developer and is stably discharged to the outside of the developer tank 131.

As shown in FIG. 6, the developer is supplied to the developing device 13*a* from the toner cartridge 40*a* via the replenishment port 133 when the toner density detecting device 138 detects that the toner density of the developing device 13*a* is lower than a predetermined value. When the developing device 13*a* develops the electrostatic latent image formed on the photoconductive drum 11*a* with the toner, the toner density in the developing device 13*a* falls. The toner density detecting device 138 detects whether the toner density in the developing device 13*a* is lower than the predetermined value. When it is detected on the basis of the output of the toner density detecting device 138 that the developer in the developing device 13*a* is little, the toner hopper 41*a* supplies the developer to the developing device 13*a* via the replenishment port 133 with a supplying roller 42*a*.

The toner density in the developing device 13*a* is maintained constant because the toner is supplied from the toner hopper 41*a* into the developing device 13*a*. The carrier is supplied to the developing device 13*a* from the toner cartridge 40*a* simultaneously with the toner. The developer in the developer tank 131 overflows to be discharged from the discharge port 134 by an amount of the supplied developer. Therefore, an amount of the developer in the developer tank 131 is maintained constant. In the developer tank 131, an old deteriorated carrier is discharged from the discharge port 134 and replaced with a new carrier little by little.

The developer is explained. As the developer according to this embodiment, a two-component developer including a toner and a magnetic carrier is used. As the toner, a toner containing binder resin and a colorant as main components is used. As the binder resin, polystyrene, styrene acryl copolymer, polyester, epoxy resin, silicon resin, polyamide, paraffin wax, and the like can be used. As the colorant, a pigment and a dye are used. Carbon black, aniline blue, pigment red, pigment yellow, and the like are used. A charging control agent, a cleaning auxiliary agent, a release accelerator, a fluidity accelerator, and the like can be contained according to necessity.

As the carrier, magnetic particles of ferrite, iron oxide, and the like can be used or a carrier obtained by coating resin with the magnetic particles as a core material. As the resin for coating the carrier, fluorine resin, acrylic resin, silicon resin, and the like can be used. These can be independently used or a combination of the plural kinds of resin can be used. For example, the resin containing magnetic powder can also be used.

The developer for supply is explained. The two-component developer in which the toner and the carrier are mixed is generated by a mixing device. A Henschel mixer or the like is used as the mixing device. A most part of the developer for supply is a toner. A small amount of carrier is mixed with the toner.

The developer supplied as explained above includes the toner and the carrier. The toner is consumed by image formation but the carrier remains in the developer tank 131 of the developing device 13*a*. Therefore, when it is attempted to keep constant the toner density of the developer in the developer tank 131, a developer amount in the developer tank 131 increases because of the supply of the developer. Therefore, the excess developer in the developer tank 131 overflows from the developer discharge port 134 for developer discharge provided in the wall surface of the developer tank 131 and is discharged to the outside of the developer tank 131. When the supply and the discharge of the developer are sequentially repeated, the old developer in the developer tank 131 is replaced with the developer supplied anew. In the developer tank 131, a characteristic of the developer is satisfactorily maintained by such supply and discharge of the developer and a developer amount is kept constant.

However, the developer amount in the developing device 13*a* depends on supply speed of the developer supplied from the toner hopper 41*a*. When the image forming apparatus 101 continuously prints images with a high printing ratio (e.g., 85%), the speed of supply of the developer to the developing device 13*a* is high. The printing ratio is a ratio of pixels subjected to image formation to all pixels for one print sheet. A large amount of developer (including a large amount of carrier) is supplied to the developing device 13*a* in a short time.

FIG. 7 is a table representing, for each printing ratio, a developer amount contained in the developing device 13*a* to which the developer is supplied after the image forming apparatus 101 continuously prints 10,000 sheets and an evaluation value of a density unevenness level of a fourth solid image when the image forming apparatus 101 continuously prints four sheets. An initial developer amount (a reference amount) of the developer contained in the developing device 13*a* is 400 g.

As the image forming apparatus 101 continuously prints an image with a high printing ratio, a developer amount contained in the developing device 13*a* increases. The evaluation value of the density unevenness level indicates that density unevenness becomes conspicuous when the value increases.

When the printing ratio is 60% and the developer amount is 480 g, the evaluation value of the density unevenness level is at a level 2 in an allowable range. When the printing ratio is 65% and the developer amount is 500 g, the evaluation value of the density unevenness level is at the very limit of the level 2 in the allowable range. When the printing ratio is 75% and the developer amount exceeds 520 g, the evaluation value of the density unevenness level is at a level 3 outside the allowable range. When the printing ratio is 85% and the developer amount exceeds 540 g, the evaluation value of the density unevenness level is deteriorated to a level 4.

Figures 14, 15:
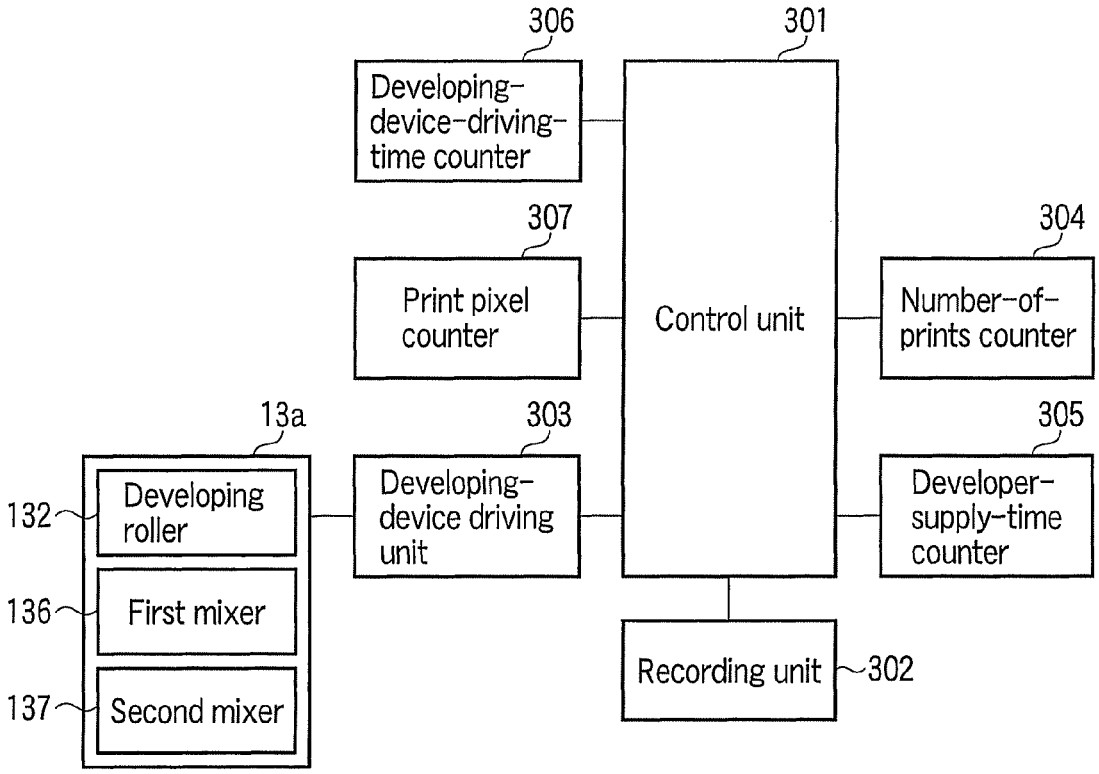
FIG. 14 is a table representing a relation between a supply ratio 1 and execution time of the forced discharge mode.
FIG. 15 is a block diagram of a control system for the image forming apparatus.

An experiment explained below was performed by using the developing device 13*a* to which the developer was supplied after the image forming apparatus 101 continuously printed 10,000 sheets at a printing ratio of 85%. The developer amount contained in the developing device 13*a* increased from the initial developer amount 400 g to the 540 g. FIG. 15 is a block diagram of a control system for the image forming apparatus 101 according to this embodiment. The image forming apparatus 101 includes a control unit 301, a recording unit 302, a developing-device driving unit 303, a number-of-prints counter 304, a developer-replenish-time counter 305, a developing-device-driving-time counter 306, and a print-pixel counter 307. The control unit 301 controls the units of the image forming apparatus 101. The recording unit 302 records various kinds of information such as an operation program of the image forming apparatus 101. The developing-device driving unit 303 controls the driving of the developing device 13*a*. For example, the developing-device driving unit 303 controls the rotation driving of the developing roller 132, the first mixer 136, and the second mixer 137. The developing-device driving unit 303 controls operation in supplying the developer from the toner cartridge 40*a* to the developing device 13*a* via the toner hopper 41*a*.

The number-of-prints counter 304 performs counting on the basis of the number of prints. The number of prints per one count is variable. The developer-replenish-time counter 305 performs counting on the basis of driving time of the developing-device driving unit 303 that supplies the developer from the toner cartridge 40*a* to the developing device 13*a* via the toner hopper 41*a*. The developer-replenish-time counter 305 counts 1, for example, every driving time 12 msec of the developing-device driving unit 303. Driving time per one count is variable. The developing-device-driving-time counter 306 performs counting on the basis of driving times of the developing roller 132, the first mixer 136, and the second mixer 137 by the developing-device driving unit 303. Driving time per one count is variable. The print pixel counter 307 performs counting on the basis of the number of pixels subjected to image formation per one print. The number of pixels per one count is variable. For example, when the developer is initially supplied to the developing device 13*a* or when the developer is replaced, the number-of-print counter 304, the developer-replenish-time counter 305, the developing-device-driving-time counter 306, and the print-pixel counter 307 reset the count to 0 and start counting. Further, when reset to 0 is commanded by the control unit 301, the number-of-print counter 304, the developer-replenish-time counter 305, the developing-device-driving-time counter 306, and the print-pixel counter 307 also reset the count to 0. The number-of-print counter 304, the developer-replenish-time counter 305, the developing-device-driving-time counter 306, and the print-pixel counter 307 perform counting for each of the colors, i.e., for each of the developing devices 13*a* to 13*d*.

First, the control unit 301 drove the first mixer 136 and the second mixer 137 at the number of revolutions same as the number of revolutions during normal printing. A developer amount overflowing and discharged from the discharge port was measured with respect to the driving time of the first mixer 136 and the second mixer 137. As a result, the following was found. The developer amount overflowing and discharged from the discharge port 134 increased according to the elapse of time. However, an absolute value of a developer amount discharged per time was small. The developing device 13*a* needed one hour or more to discharge 40*g* of the developer from the discharge port 134. Therefore, the developing device 13*a* that discharged the developer from the discharge port 134 at the number of revolutions during normal printing by the first mixer 136 and the second mixer 137 was not practical.

The same experiment was performed by using the developing device 13*a* to which the developer was supplied after the image forming apparatus 101 continuously printed 10,000 sheets at a printing ratio of 85%. The control unit 301 drove the developing roller 132 at the number of revolutions same as the number of revolutions during normal printing in addition to the first mixer 136 and the second mixer 137. A developer amount overflowing and discharged from the discharge port 134 was measured with respect to the driving time of the developing roller 132, the first mixer 136, and the second mixer 137.

As a result, the following was found. A developer amount discharged from the discharge port 134 per time increased from that at the time when the first mixer 136 and the second mixer 137 were driven. However, the developing device 13*a* needed 30 minutes or more to discharge 40*g* of the developer from the discharge port 134. Therefore, the developing device 13*a* that discharged the developer from the discharge port 134 at the number of revolutions during normal printing by the developing roller 132, the first mixer 136, and the second mixer 137 was not practical.

The same experiment was performed by using the developing device 13*a* to which the developer was supplied after the image forming apparatus 101 continuously printed 10,000 sheets at a printing ratio of 85%. The control unit 301 drove the developing roller 132, the first mixer 136, and the second mixer 137 at the number of revolutions half of the number of revolutions during normal printing. A developer amount overflowing and discharged from the discharge port 134 was measured with respect to the driving time of the developing roller 132, the first mixer 136, and the second mixer 137.

As a result, the following was found. A developer amount discharged from the discharge port 134 per time increased from that at the time when the developing roller 132, the first mixer 136, and the second mixer 137 were driven at the number of revolutions during normal printing. The developing device 13*a* needed 3 minutes to discharge 40*g* of the developer from the discharge port 134. Therefore, the developing device 13*a* that discharged the developer from the discharge port 134 at the number of revolutions half of the number of revolutions during normal printing by the developing roller 132, the first mixer 136, and the second mixer 137 was at a practical level.

Further, the same experiment was performed by using the developing device 13*a* to which the developer was supplied after the image forming apparatus 101 continuously printed 10,000 sheets at a printing ratio of 85%. The control unit 301 drove the developing roller 132, the first mixer 136, and the second mixer 137 at the number of revolutions one third of the number of revolutions during normal printing. A developer amount overflowing and discharged from the discharge port 134 was measured with respect to the driving time of the developing roller 132, the first mixer 136, and the second mixer 137.

As a result, the following was found. A developer amount discharged from the discharge port 134 per time decreased from that at the time when, the developing roller 132, the first mixer 136, and the second mixer 137 were driven at the number of revolutions half of the number of revolutions during normal printing. The developing device 13*a* needed 8 minutes to discharge 40*g* of the developer from the discharge port 134. Therefore, the developing device 13*a* that discharged the developer from the discharge port 134 at the number of revolutions one third of the number of revolutions during normal printing by the developing roller 132, the first mixer 136, and the second mixer 137 was at a practical level.

Compared with the case in which the developing roller 132, the first mixer 136, and the second mixer 137 were driven at the number of revolutions during normal printing, a developer amount discharged per time increased when the developing roller 132, the first mixer 136, and the second mixer 137 were driven at the number of revolutions half to one third of the number of revolutions during normal printing. As reason for this, a reason explained below is conceivable.

When the number of revolutions of the first mixer 136 and the second mixer 137 is smaller than the number of revolutions during normal printing, the swell of the developer surface is large near the discharge port 134 as shown in FIG. 5. As a result, the developer contained in the developing device 13*a* tends to be discharged from the discharge port 134.

When the developing roller 132 is stopped to be driven, a developer amount held by a pumping-up pole of the developing roller 132 increases from that held when the developing roller 132 is driving. Therefore, in the space of the developer tank 131 in which the first mixer 136 is provided, a developer amount flowing from the upstream side on which the developing roller 132 is provided to the downstream side on which the discharge port 134 is provided decreases. As a result, since the developing roller 132 is stopped to be driven, the effect of the swell of the developer surface near the discharge port 134 is cancelled.

Consequently, if the number of revolutions of the developing roller 132, the first mixer 136, and the second mixer 137 are set smaller than the number of revolutions during normal printing, the effect of the swell of the developer surface near the discharge port 134 is sufficiently obtained. As a result, a developer amount discharged from the discharge port 134 substantially increases. A method of discharging the developer by driving the developing roller 132, the first mixer 136, and the second mixer 137 in this way is referred to as forced discharge mode.

When the image forming apparatus 101 continuously prints a large number of sheets at a printing ratio equal to or lower than 65% as shown in FIG. 7, even if the forced discharge mode is not executed, the developer overflows and is discharged from the discharge port 134 simply by driving the developing roller 132, the first mixer 136, and the second mixer 137 at the number of revolutions same as the number of revolutions during normal printing. Therefore, in this case, a developer amount contained in the developing device 13*a* is maintained at an amount with which the evaluation value of the density unevenness level is at the level 2.

The control unit 301 executes the forced discharge mode as explained below. When an average printing ratio exceeds 60%, the control unit 301 executes the forced discharge mode. The control unit 301 calculates the average printing ratio every time 500 sheets are continuously printed. When the image forming apparatus 101 continuously prints 500 sheets at a printing ratio of 85%, about 34 g of carrier is supplied to the developing device 13*a* from the toner cartridge 40*a* together with the toner. It could be confirmed that, up to the average printing ratio of 85%, when the control unit 301 executed the forced discharge mode, the developer amount in the developing device 13*a* could be maintained at an amount with which an image having a density unevenness evaluation value at the level 2 could be maintained. The control unit 301 executes the forced discharge mode if a printing ratio is equal to or larger than a predetermined value. However, the control unit 301 may execute the forced discharge mode if a supply ratio is equal to or larger than a predetermined value. As the printing ratio increases, a developer amount supplied to the developing device 13*a* increases. This is because there is a correlation between the printing ratio and the supply ratio of the developer. Calculation of the printing ratio and the supply ratio is explained later.

Figure 8:
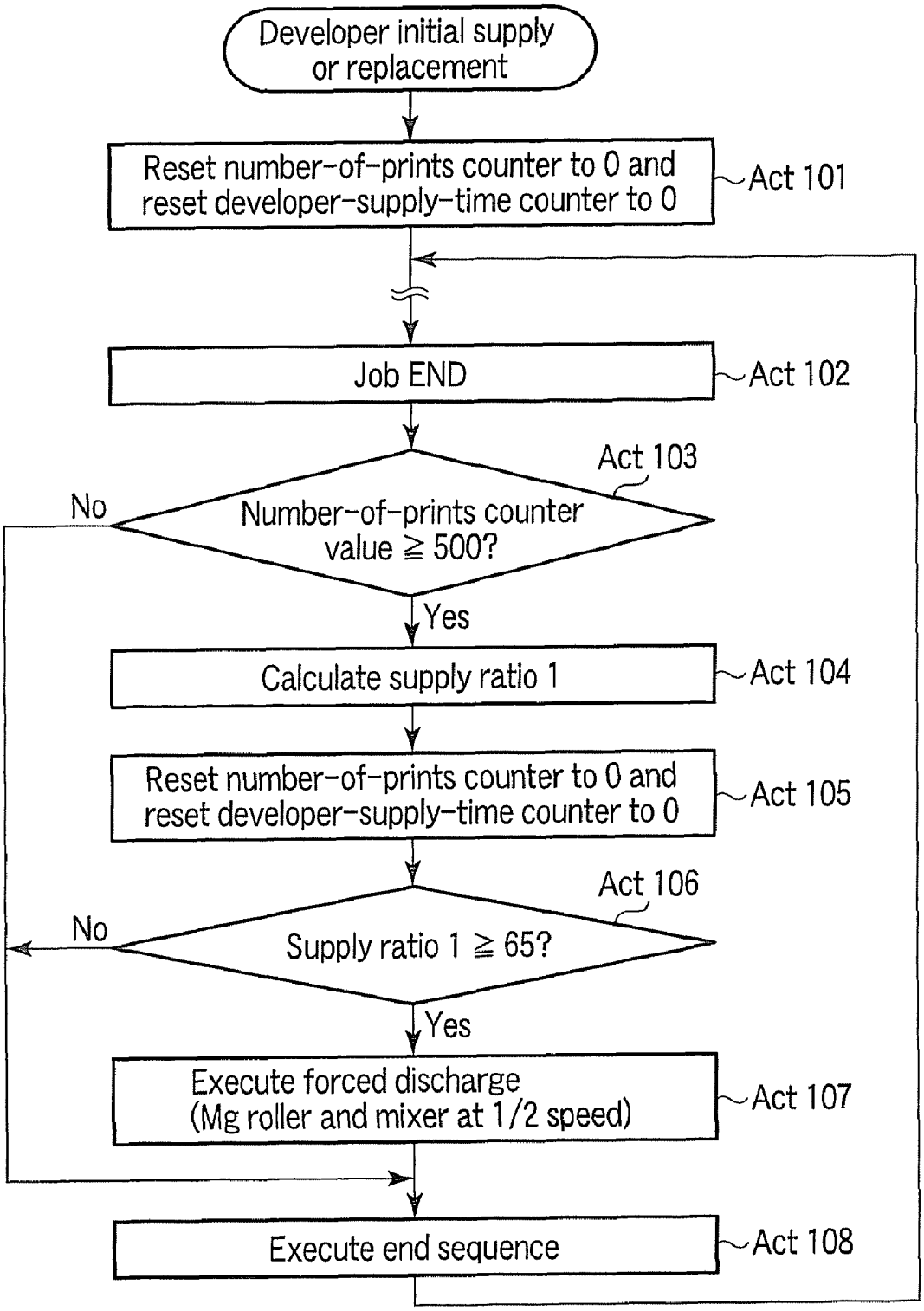
FIG. 8 is a flowchart for explaining a sequence according to a first embodiment of the present invention.

A sequence according to a first embodiment of the forced discharge mode explained above is explained. FIG. 8 is a flowchart for explaining the sequence according to the first embodiment of the forced discharge mode for developers. In the first embodiment, a count value by the number-of-prints counter 304 and a count value by the developer-replenish-time counter 305 are used. In the first embodiment, a developer amount supplied to the developing devices 13*a* to 13*d* (a supply developer amount) is estimated on the basis of a supply ratio 1 calculated by using the count values by the two counters.

First, when the developers are initially supplied to the developing devices 13*a* to 13*d* or the developers are replaced, the control unit 301 resets the number-of-prints counter 304 and the developer-replenish-time counter 305 after initial operation (e.g., toner density adjustment operation) or the like by the developing devices 13*a* to 13*d* (Act 101). When the developers in the developing devices 13*a* to 13*d* are replaced, a user may manually reset the number-of-prints counter 304 and the developer-replenish-time counter 305.

When a job is input, the control unit 301 executes a printing sequence and ends the job (Act 102). Subsequently, the control unit 301 acquires a count value by the number-of-prints counter 304. The control unit 301 determines whether the count value by the number-of-prints counter 304 is equal to or larger than 500 (Act 103).

If the count value by the number-of-prints counter 304 is smaller than 500 (NO in Act 103), the control unit 301 carries out an end sequence without executing the forced discharge mode (Act 108). The developing device 13*a* prepares for the next printing. The control unit 301 does not reset the number-of-prints counter 304 and the developer-replenish-time counter 305.

When the count value by the number-of-prints counter 304 is equal to or larger than 500 (YES in Act 103), the control unit 301 acquires a count value by the developer-replenish-time counter 305. The control unit 301 calculates the supply ratio 1 using formulas described below (Act 104).

A calculation method for the supply ratio 1

Concerning the developing device 13*a* that contains the yellow toner (Y) supply ratio 1=((Y) developer replenish time count value/(Y) number of prints count value)×10

Concerning the developing device 13*b* that contains the magenta toner (M) supply ratio 1=((M) developer replenish time count value/(M) number of prints count value)×10

Concerning the developing device 13*c* that contains the cyan toner (C) supply ratio 1=((C) developer replenish time count value/(C) number of prints count value)×10

Concerning the developing device 13*d* that contains the black toner (K) supply ratio 1=((K) developer replenish time count value/(K) number of prints count value)×10

The control unit 301 resets the number-of-prints counter 304 and the developer-replenish-time counter 305 (Act 105). Subsequently, the control unit 301 determines, concerning the four colors C, M, Y, and K, whether the (Y) supply ratio 1, the (M) supply ratio 1, the (C) supply ratio 1, and the (K) supply ratio 1 are equal to or larger than 65 (Act 106). If the supply ratio 1 of any one of the four colors C, M, Y, and K is equal to or larger than 65 (YES in Act 106), the control unit 301 executes the forced discharge mode for all the developing devices 13*a* to 13*d*. The control unit 301 drives the developing roller 132, the first mixer 136, and the second mixer 137 for a predetermined time (3 minutes) set in advance at the number of revolutions half of the number of revolutions during normal printing. Thereafter, the driving unit 301 carries out an end sequence (Act 108). The developing device 13*a* prepares for the next printing.

If the supply ratios 1 of all the four colors C, M, Y, and K are smaller than 65 (NO in Act 106), the control unit 301 carries out the end sequence without executing the forced discharge mode (Act 108).

As long as the developer contained in the developing device 13*a* is maintained at the amount with which the evaluation value of the density unevenness level is at the level 2, the threshold 500 in Act 103 and the threshold 65 in Act 106 are variable.

Figure 9:
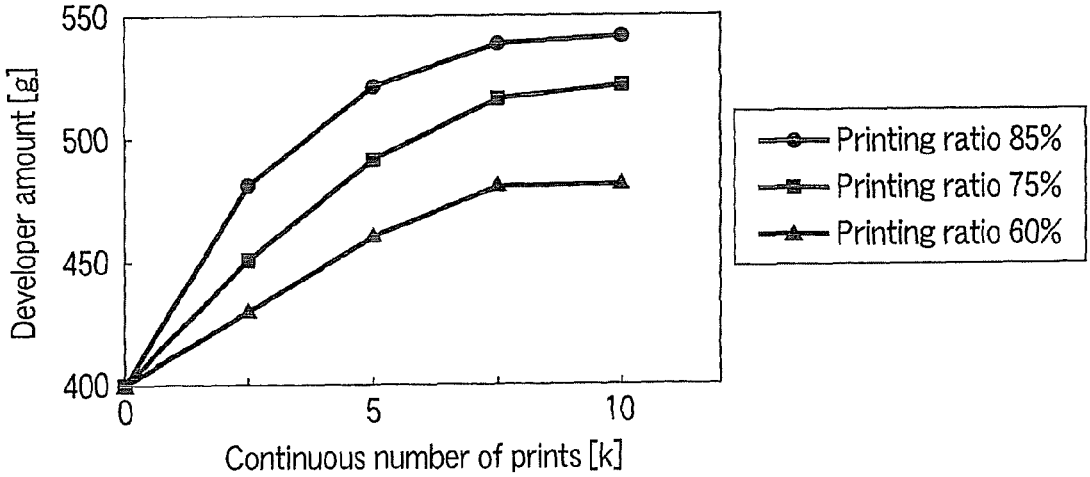
FIG. 9 is a graph of a change in a developer amount in the case in which a forced discharge mode is not applied.
Figure 10:
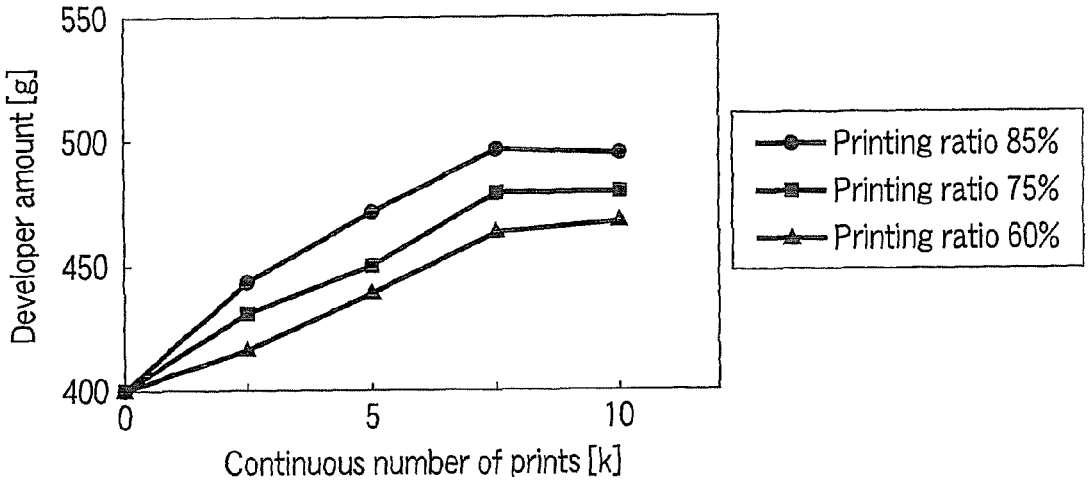
FIG. 10 is a graph of a change in a developer amount in the case in which the forced discharge mode is applied.

FIG. 9 is a graph of a change in a developer amount contained in the developing device 13*a* with respect to the number of prints in the case in which the forced discharge mode is not applied. FIG. 10 is a graph of a change in a developer amount contained in the developing device 13*a* with respect to the number of prints in the case in which the forced discharge mode according to the first embodiment is applied shown in FIG. 8. In the graphs, printing ratios are 60%, 75%, and 85%. The developer amounts contained in the developing device 13*a* in the case in which the forced discharge mode is not applied and the case in which the forced discharge mode is applied are compared.

As shown in FIG. 9, when the number of sheets continuously printed by the image forming apparatus 101 increases, the developer amount contained in the developing device 13*a* also increases. When the image forming apparatus 101 continuously prints 10,000 sheets at the printing ratio of 60%, as shown in FIG. 7, the developer amount contained in the developing device 13*a* is 480 g. Therefore, the evaluation value of the density unevenness level is at the level 2 in the allowable range. However, when the image forming apparatus 101 continuously prints 10,000 sheets at pint ratios of 75% and 85%, as shown in FIG. 7, the developer amount contained in the developing device 13*a* exceeds 500 g. Therefore, the evaluation value of the density unevenness level is at the level 3 or more or the lower level outside the allowable range.

On the other hand, even when the image forming apparatus 101 continuously prints 10,000 sheets at any one of printing ratios 65%, 75%, and 85% in the forced discharge mode according to the first embodiment, as shown in FIG. 7, the developer amount contained in the developing device 13*a* is saturated and does not exceed 500 g. It could be confirmed that the evaluation value of the density unevenness level could maintain the level 2 in the allowable range.

Figure 11:
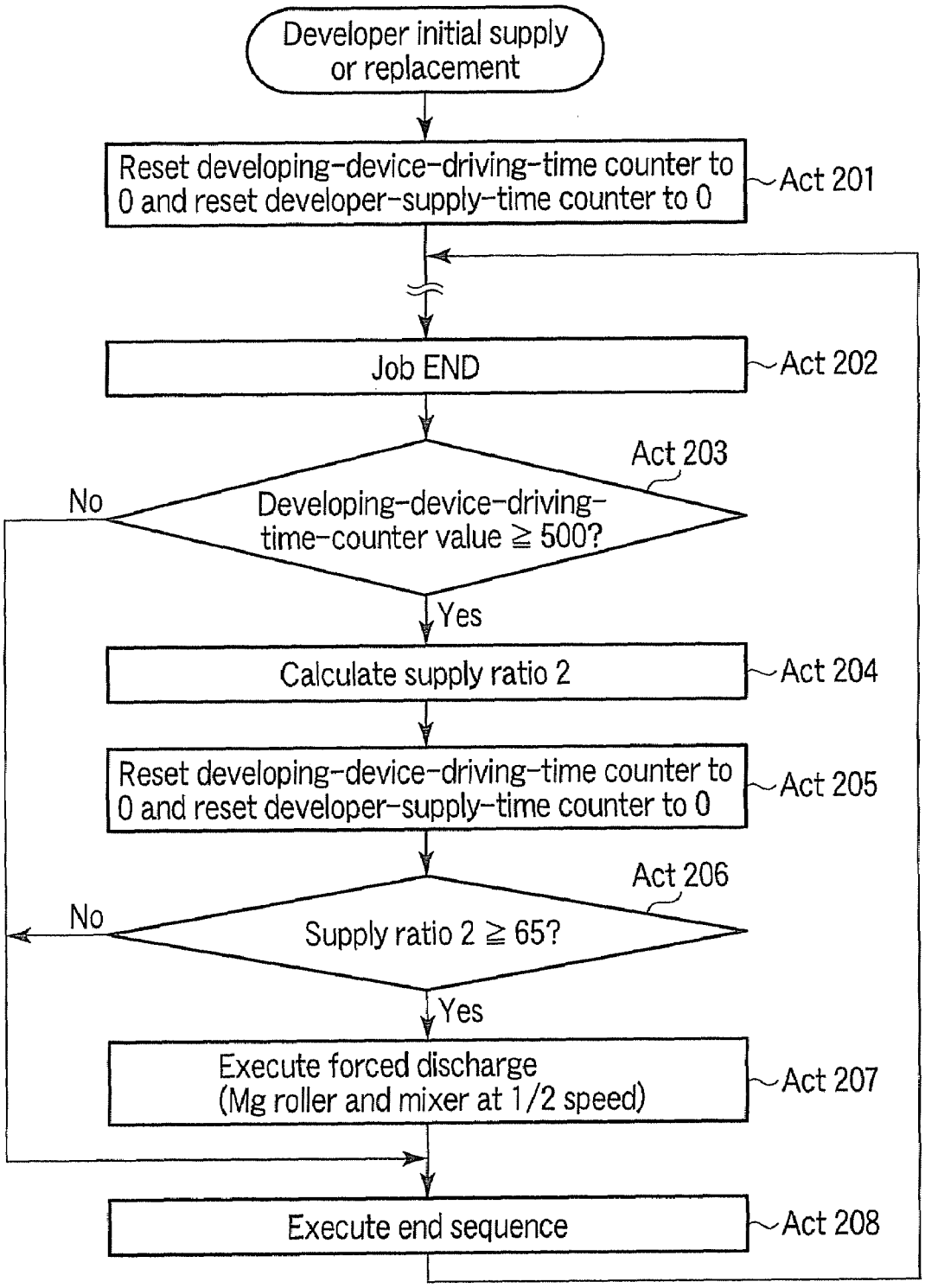
FIG. 11 is a flowchart for explaining a sequence according to a second embodiment of the present invention.

A sequence according to a second embodiment of the forced discharge mode explained above is explained. FIG. 11 is a flowchart for explaining the sequence according to the second embodiment of the forced discharge mode for developers. In the second embodiment, a count value by the developer-replenish-time counter 305 and a count value by the developing-device-driving-time counter 306 are used. In the second embodiment, supply developer amounts to the developing devices 13*a* to 13*d* are estimated on the basis of a supply ratio 2 calculated by using the count values by the two counters.

The second embodiment is different from the first embodiment in that the developing-device-driving-time counter 306 is used instead of the number-of-prints counter 304. Acts 201 to 208 in the second embodiment shown in FIG. 11 respectively correspond to Acts 101 to 108 in the first embodiment shown in FIG. 8. Explanation of components same as those in the first embodiment is omitted.

In the second embodiment, in Acts 201 and 205, the control unit 301 resets the developer-replenish-time counter 305 and the developing-device-driving-time counter 306. In Act 203, the control unit 301 determines whether the count value by the developing-device-driving-time counter 306 is equal to or larger than 500. In Act 204, the control unit 301 calculates the supply ratio 2 using formulas described below. In Act 206, the control unit 301 determines, concerning the four colors C, M, Y, and K, whether the (Y) supply ratio 2, the (M) supply ratio 2, the (C) supply ratio 2, and the (K) supply ratio 2 are equal to or larger than 65.

A calculation method for the supply ratio 2

Concerning the developing device 13*a* that contains the yellow toner (Y) supply ratio 2=((Y) developer replenish time count value/(Y) developing device driving time count value)×10

Concerning the developing device 13*b* that contains the magenta toner (M) supply ratio 2=((M) developer replenish time count value/(M) developing device driving time count value)×10

Concerning the developing device 13*c* that contains the cyan toner (C) supply ratio 2=((C) developer replenish time count value/(C) developing device driving time count value)×10

Concerning the developing device 13*d* that contains the black toner (K) supply ratio 2=((K) developer replenish time count value/(K) developing device driving time count value)×10

The second embodiment has an effect of suppressing the developer amount contained in the developing device 13*a* as in the first embodiment.

Figure 12:
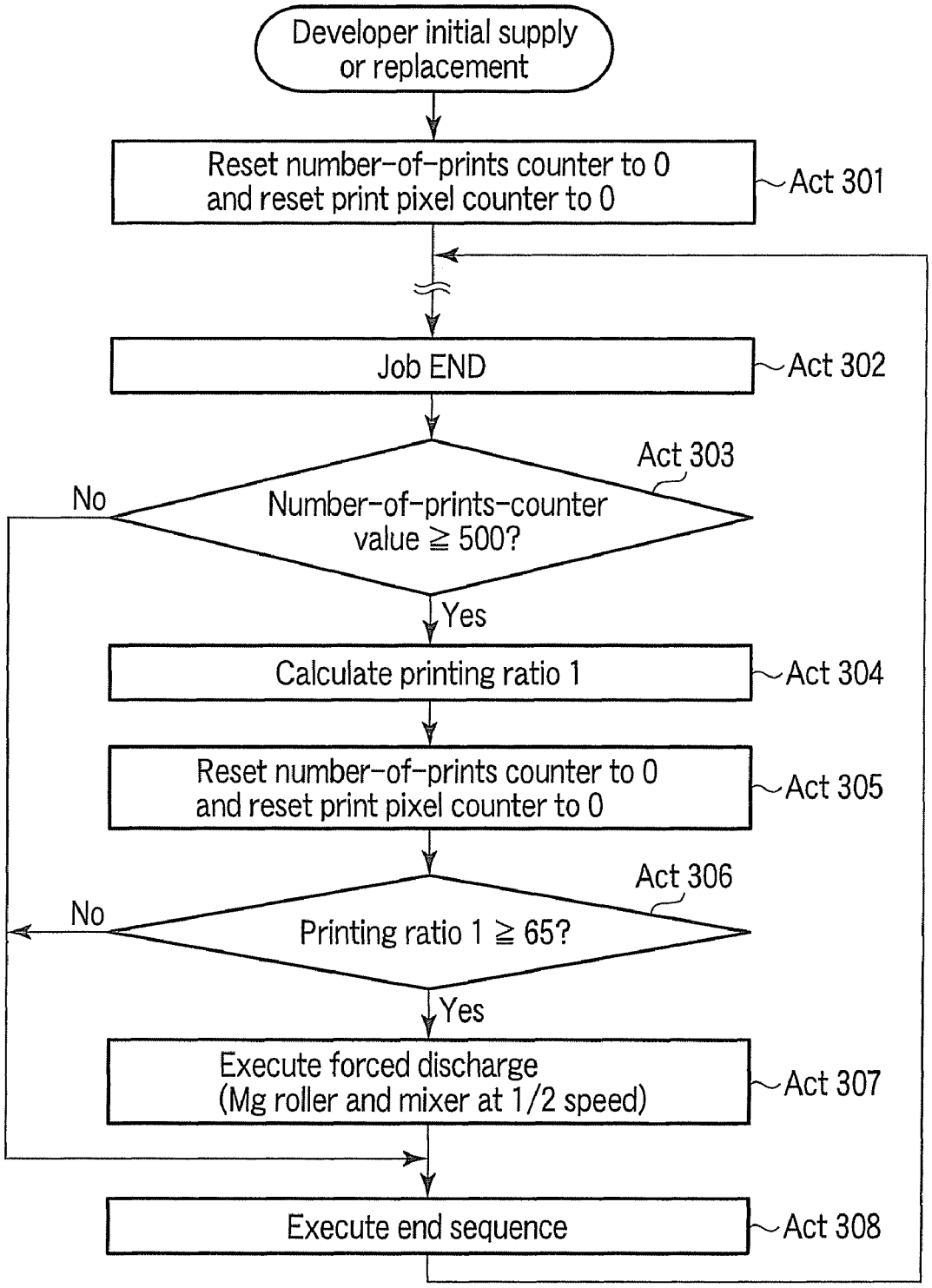
FIG. 12 is a flowchart for explaining a sequence according to a third embodiment of the present invention.

A sequence according to a third embodiment of the forced discharge mode explained above is explained. FIG. 12 is a flowchart for explaining the sequence according to the third embodiment of the forced discharge mode for developers. In the third embodiment, a count value by the number-of-prints counter 304 and a count value by the print pixel counter 307 are used. In the third embodiment, supply developer amounts to the developing devices 13*a* to 13*d* are estimated on the basis of the printing ratio 1 calculated by using the count values by the two counters.

The third embodiment is different from the first embodiment in that the print pixel counter 307 is used instead of the developer-replenish-time counter 305. Acts 301 to 308 in the third embodiment shown in FIG. 12 respectively correspond to Acts 101 to 108 in the first embodiment shown in FIG. 8. Explanation of components same as those in the first embodiment is omitted.

In the third embodiment, in Acts 301 and 305, the control unit 301 resets the number-of-prints counter 304 and the print pixel counter 307. In Act 304, the control unit 301 counts the printing ratio 1 using formulas described below. In Act 306, the control unit 301 determines, concerning the four colors C, M, Y, and K, whether the (Y) printing ratio 1, the (M) printing ratio 1, the (C) printing ratio 1, and the (K) printing ratio 1 are equal to or larger than 65.

A calculation method for the printing ratio 1

Concerning the developing device 13*a* that contains the yellow toner (Y) printing ratio 1=((Y)print pixel count value/(Y) number of prints count value)×10

Concerning the developing device 13*b* that contains the magenta toner (M) printing ratio 1=((M)print pixel count value/(M) number of prints count value)×10

Concerning the developing device 13*c* that contains the cyan toner (C) printing ratio 1=((C)print pixel count value/(C) number of prints count value)×10

Concerning the developing device 13*d* that contains the black toner (K) printing ratio 1=((K)print pixel count value/(K) number of prints count value)×10

The third embodiment has an effect of suppressing the developer amount contained in the developing device 13*a* as in the first embodiment.

Figure 13:
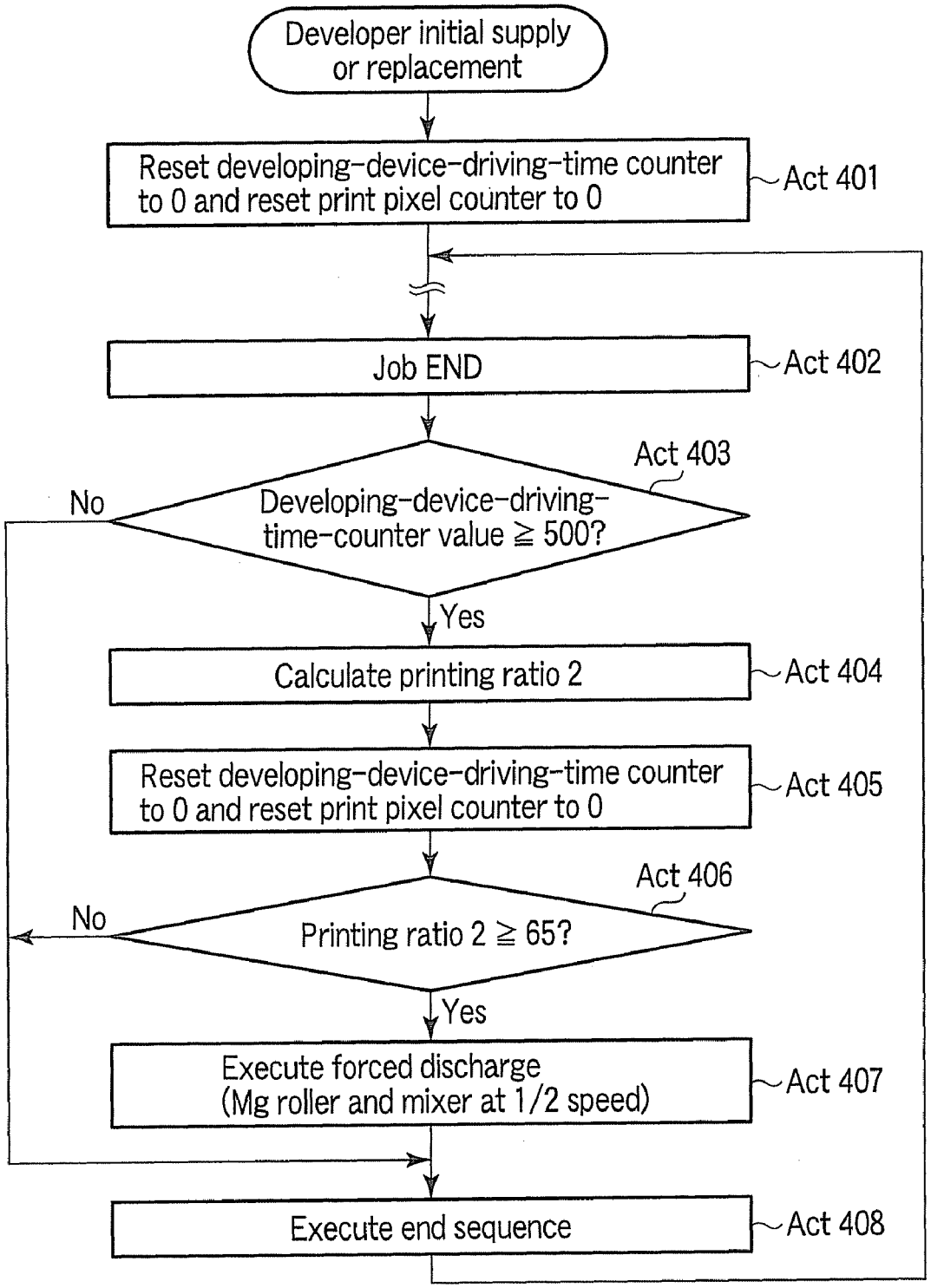
FIG. 13 is a flowchart for explaining a sequence according to a fourth embodiment of the present invention.

A sequence according to a fourth embodiment of the forced discharge mode explained above is explained. FIG. 13 is a flowchart for explaining the sequence according to the fourth embodiment of the forced discharge mode for developers. In the fourth embodiment, a count value by the developing-device-driving-time counter 306 and a count value by the print pixel counter 307 are used. In the fourth embodiment, supply developer amounts to the developing devices 13*a* to 13*d* are estimated on the basis of the printing ratio 2 calculated by using the count values by the two counters.

The fourth embodiment is different from the first embodiment in that the developing-device-driving-time counter 306 and the print pixel counter 307 are used instead of the number-of-prints counter 304 and the developer-replenish-time counter 305. Acts 401 to 408 in the fourth embodiment shown in FIG. 13 respectively correspond to Acts 101 to 108 in the first embodiment shown in FIG. 8. Explanation of components same as those in the first embodiment is omitted.

In the fourth embodiment, in Acts 401 and 405, the control unit 301 resets the developing-device-driving-time counter 306 and the print pixel counter 307. In Act 403, the control unit 301 determines whether the count value by the developing-device-driving-time counter 306 is equal to or larger than 500. In Act 404, the control unit 301 calculates the printing ratio 2 using formulas described below. In Act 406, the control unit 301 determines, concerning the four colors C, M, Y, and K, whether the (Y) printing ratio 2, the (M) printing ratio 2, the (C) printing ratio 2, and the (K) printing ratio 2 are equal to or larger than 65.

A calculation method for the printing ratio 2

Concerning the developing device 13*a* that contains the yellow toner (Y) printing ratio 2=((Y)print pixel count value/(Y) developing device driving time count value)×10

Concerning the developing device 13*b* that contains the magenta toner (M) printing ratio 2=((M)print pixel count value/(M) developing device driving time count value)×10

Concerning the developing device 13*c* that contains the cyan toner (C) printing ratio 2=((C)print pixel count value/(C) developing device driving time count value)×10

Concerning the developing device 13*d* that contains the black toner (K) printing ratio 2=((K)print pixel count value/(K) developing device driving time count value)×10

The fourth embodiment has an effect of suppressing the developer amount contained in the developing device 13*a* as in the first embodiment.

In the first embodiment, execution time of the forced discharge mode is set to the predetermined time set in advance. However, the execution time may be changed according to a value of the supply ratio 1. FIG. 14 is a table representing a relation between the supply ratio 1 and the execution time of the forced discharge mode. As a value of the supply ratio 1 increases, the execution time of the forced discharge mode is set longer. The recording unit 302 records information shown in FIG. 14. The control unit 301 determines the execution time of the forced discharge mode with reference to the information shown in FIG. 14 according to the values of the supply ratio 1 calculated in Act 104 in FIG. 8.

In this case, the developer amount contained in the developing device 13*a* can be more efficiently suppressed. As a result, a solid image can be maintained as a satisfactory image without a blur. The same holds true in the cases of the supply ratio 2, the printing ratio 1, and the printing ratio 2 in the second to fourth embodiments.

In the first embodiment, the value calculated from (developer replenish time count value/number of prints count value) is multiplied by 10 to calculate the supply ratio 1. However, the calculation of the supply ratio 1 is not limited to this. The supply ratio 1 only has to include the value calculated from (developer replenish time count value/number of prints count value). The value may be multiplied by 20 or some value may be added to the value. The same holds true for the supply ratio 2, the printing ratio 1, and the printing ratio 2.

According to the first to fourth embodiments, it is possible to estimate a developer supply amount, forcibly discharge the developer from the developing device 13*a* when a value of the developer supply amount is equal to or larger than a predetermined value, and maintain the developer amount in the developing device 13*a* and the height of the developer surface under the developer roller 132 at levels in the allowable range. According to the first to fourth embodiments, it is possible to prevent an image failure such as a blur of a solid image from occurring and maintain an image quality. Further, according to the first to fourth embodiments, since the supply of the new developer including the toner and the carrier and the discharge of the deteriorated developer are simultaneously performed, it is possible to maintain performance of the developer in the developing device 13*a*.

What is claimed is:

1. A developing apparatus comprising:

a tank configured to contain a developing agent including a toner and a carrier, the tank having a discharge port configured to discharge the developing agent overflowing from the tank, a supplier configured to develop a latent image by using the toner contained in the tank, a replenisher configured to contain the developing agent and to replenish the developing agent into the tank; and a controller configured to estimate an amount of the developing agent in the tank in according with the amount of the supplied developing agent and the amount of the replenished developing agent and to execute a forced discharge for forcibly discharging the developing agent contained in the tank from the discharge port based on the estimated amount of developing agent.

2. The apparatus of claim 1, wherein the controller executes the forced discharge when the amount of the replenished developing agent is equal to or larger than a predetermined value.

3. The apparatus of claim 2, wherein the controller estimates the amount of the replenished developing agent according to a value calculated by any one of following formulas:

(developing agent replenish time count value/number of prints count value);

(developing agent replenish time count value/developing apparatus driving time count value);

(print pixel count value/number of prints count value); or (print pixel count value/developing apparatus driving time count value)

where, the developing agent replenish time count value is a value corresponding to time for replenishing the developing agent from the replenisher to the tank, the number of prints count value is a value corresponding to a number of printed sheets, the developing apparatus driving time count value is a value corresponding to driving time of the supplier and a mixer configured to agitate the developing agent contained in the tank, and the print pixel count value is a value corresponding to the number of print pixels.

4. The apparatus of claim 3, wherein the mixer and the supplier rotate at a number of revolutions smaller than a number of revolutions during normal printing while the forced discharge is executed.

5. The apparatus of claim 4, wherein the mixer and the supplier rotate at a number of revolution half to one third of the number of revolutions during normal printing while the forced discharge is executed.

6. The apparatus of claim 5, wherein the controller executes the forced discharge for a predetermined time.

7. The apparatus of claim 5, wherein the controller executes the forced discharge for time corresponding to a magnitude of the value of any one of the four formulas.

8. The apparatus of claim 5, wherein the controller executes the forced discharge when the controller determines that the developing apparatus driving time count value or the number of prints count value is equal to or larger than a predetermined value.

9. The apparatus of claim 5, wherein, when a plurality of the developing apparatuses are provided, the controller executes the forced discharge for all the plurality of the developing apparatuses when the controller estimates that the amount of the replenished developing agent replenished to any one of the developing apparatuses is equal to or larger than the predetermined value.

10. The apparatus of claim 2, wherein the discharge port has a rectangular shape, a lower end of the discharge port is provided in a horizontal direction of the tank and is provided on an opposite side in the longitudinal direction of the tank of a side on which the supplier is provided and on a downstream side in a direction in which the developing agent flows, a mixer carries the developing agent in a fixed direction in the longitudinal direction, and in the tank, height between the side on which the supplier is provide and the side on which the discharge port is provided is low compared with that of other positions.

11. A developing method used for a developing apparatus comprising: a tank that contains a developing agent including a toner and a carrier, the tank having a discharge port that discharges the developing agent overflowing from the tank, a supplier that develops a latent image by using the toner contained in the tank; and a replenisher that contains the developing agent and replenishes the developing agent into the tank, the method comprising:

estimating an amount of the developing agent in the tank in according with the amount of the supplied developing agent and the amount of the replenished developing agent; and executing a forced discharge for forcibly discharging the developing agent contained in the tank from the discharge port based on the estimated amount of developing agent.

12. The method of claim 11, further comprising:

executing the forced discharge when the amount of the replenished developing agent is equal to or larger than a predetermined value.

13. The method of claim 12, further comprising estimating the amount of the replenished developing agent according to a value calculated by any one of following formulas:

(developing agent replenish time count value/number of prints count value);

(developing agent replenish time count value/developing apparatus driving time count value);

(print pixel count value/number of prints count value); or (print pixel count value/developing apparatus driving time count value)

where, the developing agent replenish time count value is a value corresponding to time for replenishing the developing agent from the replenisher to the tank, the number of prints count value is a value corresponding to a number of printed sheets, the developing apparatus driving time count value is a value corresponding to driving time of the supplier and a mixer that agitates the developing agent contained in the tank, and the print pixel count value is a value corresponding to the number of print pixels.

14. The method of claim 13, further comprising rotating the mixer and the supplier at a number of revolutions smaller than a number of revolutions during normal printing while the forced discharge is executed.

15. The method of claim 14, further comprising rotating the mixer and the supplier at a number of revolution half to one third of the number of revolutions during normal printing while the forced discharge is executed.

16. The method of claim 15, further comprising executing the forced discharge for a predetermined time.

17. The method of claim 15, further comprising executing the forced discharge for time corresponding to a magnitude of the value of any one of the four formulas.

18. The method of claim 15, further comprising executing the forced discharge when it is determined that the developing apparatus driving time count value or the number of prints count value is equal to or larger than a predetermined value.

19. The method of claim 15, further comprising, when a plurality of the developing apparatuses are provided, executing the forced discharge for all the plurality of the developing apparatuses when it is estimated that the amount of the replenished developing agent replenished to any one of the developing apparatuses is equal to or larger than the predetermined value.

20. A developing apparatus comprising:

first means for containing a developing agent including a toner and a carrier, second means for discharging the developing agent overflowing from the first means, third means for developing a latent image by supplying the toner, fourth means for containing the developing agent and replenishing the developing agent into the first means, fifth means for estimating an amount of the developing agent in the first means in according with the amount of the supplied developing agent and the amount of the replenished developing agent; and sixth means for executing a forced discharge for forcibly discharging the developing agent contained in the first means from the second means based on the estimated amount of developing agent.

* * * * *